US005143258A

United States Patent [19]

Mittermaier

[11] Patent Number: 5,143,258

[45] Date of Patent: Sep. 1, 1992

[54] PRESSURE RELIEF FOR VACUUM OPERATED VALVE

[75] Inventor: Armin E. Mittermaier, Fort Wayne, Ind.

[73] Assignee: Tokheim Corporation, Fort Wayne, Ind.

[21] Appl. No.: 700,583

[22] Filed: May 15, 1991

[51] Int. Cl.[5] ..... B67D 5/16

[52] U.S. Cl. ..... 222/73; 137/110; 137/599; 222/318

[58] Field of Search ..... 222/71-73, 222/318; 137/599, 110, 115, 116

[56] References Cited

U.S. PATENT DOCUMENTS

| | | | |
|---|---|---|---|
| 1,383,708 | 7/1921 | Farr | 222/73 |
| 1,963,270 | 6/1934 | Huffman et al. | 222/73 X |
| 2,632,458 | 3/1953 | Slomer | 137/108 |
| 2,958,291 | 11/1960 | Rittenhouse | 222/73 X |
| 2,996,222 | 8/1961 | Botkin | 222/73 X |
| 3,113,700 | 12/1963 | Chaffee et al. | 222/73 X |
| 3,120,325 | 2/1964 | Tye et al. | 222/318 X |
| 3,160,332 | 12/1964 | Brunson | 222/318 |
| 3,524,465 | 8/1970 | Sedker | 137/115 |
| 3,707,981 | 1/1973 | Sadler et al. | 137/115 |
| 3,723,025 | 3/1973 | Coakley | 417/299 |
| 4,111,223 | 9/1978 | Gelnett | 137/115 |

OTHER PUBLICATIONS

Publication of Tokheim Corporation Entitled "Model 52 Pressure Regulator".

*Primary Examiner*—Kevin P. Shaver
*Attorney, Agent, or Firm*—Baker & Daniels

[57] ABSTRACT

A liquid fuel dispensing system having a fuel reservoir and a plurality of remote fuel dispensers, each of which including a suction pump and a pressure regulator valve positioned in the fuel conduit on the inlet side of the suction pump. A pressure relief passage is positioned in the fuel conduit in parallel with the regulator valve. When the vapor pressure of the fuel on the inlet side of the regulator valve exceeds a predetermined pressure, the pressure relief valve opens to permit the flow of fuel through the relief passage within the conduit, thus by-passing the regulator valve.

4 Claims, 1 Drawing Sheet

PRESSURE RELIEF FOR VACUUM OPERATED VALVE

BACKGROUND OF THE INVENTION

The present invention relates generally to liquid fuel dispensing systems utilizing suction pumps, and more particularly to pressure regulators for regulating line pressure on the inlet side of the pump.

Fuel dispensing stations generally include a liquid fuel reservoir, a plurality of remote individual island dispensers, and a large amount of piping to produce the fuel lines that extend from the reservoir to the remote dispensers. Each individual dispenser includes a conventional suction pump and a pressure regulator valve located on the inlet side of the suction pump to control line pressure. The regulator valve is normally closed so that head pressure of the fuel storage tank cannot cause fuel to flow through the suction pump, into the air eliminator chamber, out the air vent tube, and onto the ground. The valve only opens when a vacuum is drawn by the suction pump, e.g. when the pump is actuated by a customer, who desires to deliver fuel through the hose and nozzle to a vehicle or a portable fuel can.

The regulator valve may be used in booster systems with a submerged pump in an underground fuel storage tank. Alternatively, the valve may be used in power-gravity installations having an above-ground storage tank. One such pressure regulator valve that has performed effectively in both systems is the Model 52 Pressure Regulator, commercially available from Tokheim Corporation in Fort Wayne, Ind.

One problem associated primarily with above-ground storage tanks is that the fuel stored therein is generally susceptible to atmospheric conditions, and especially to solar heating resulting in thermal expansion of the fuel. Since the regulator valve is generally closed, fuel in the piping on the inlet side of the valve can develop pressures of 1,000 psi or more, which is sufficient to blow out the gaskets in the regulator valve thereby permitting fuel to drain onto the ground.

It is desired to provide a regulator valve, wherein such problem can be avoided.

SUMMARY OF THE INVENTION

The present invention provides a pressure regulator for regulating conduit pressure, wherein the regulator includes a pressure relief device having a passage in the conduit to bypass fluid flow through the regulator and a pressure relief valve within the passage for intermittently enabling the flow of fuel through the passage when the vapor pressure of the fuel exceeds a predetermined value.

One advantage of the fuel dispensing system according to the present invention is that the pressure regulator is initially equipped with a pressure relief device, thereby eliminating the need for installers to install pressure relief valves in all of the other valves in the same piping.

Another advantage of the fuel dispensing system according to the present invention is that the pressure relief device provides a passage that bypasses the pressure regulator, thereby protecting the valve gaskets of the pressure regulator from excessive line pressure at the inlet end.

Yet another advantage of the fuel dispensing system according to the present invention is that the pressure relief device is positioned completely within the fuel conduit, thereby eliminating the possibility of fuel being spilled onto the ground.

The present invention, in one form thereof, provides a liquid fuel dispensing system including a liquid fuel reservoir, a valved nozzle, a fluid conduit providing fluid communication between the reservoir and the nozzle, and an actuable pump for pumping liquid fuel through the conduit. A valved pressure regulator is provided in the conduit for permitting the passage of fuel through the conduit upon actuation of the pump. The regulator includes a fluid inlet and outlet. The conduit may be defined as having an upstream portion positioned between the reservoir and the inlet and a downstream portion positioned between the outlet and the nozzle. A passage is located in parallel with the regulator for permitting fuel to flow directly from the upstream portion to the downstream portion and thereby bypassing the regulator. A pressure relief valve is associated with the passage for intermittently enabling the flow of fuel from the upstream portion to the downstream portion. The pressure relief valve enables fuel flow when the vapor pressure of the fuel in the upstream portion exceeds a predetermined value.

DESCRIPTION OF THE PREFERRED EMBODIMENT

Figure 1:
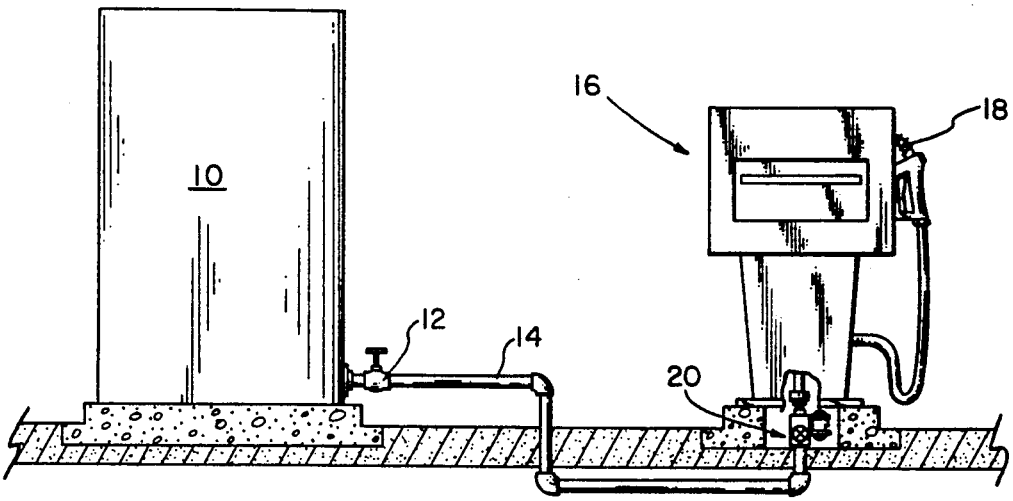
FIG. 1 is a diagrammatic view of a typical fuel dispensing installation that includes the pressure regulator and pressure relief valve according to the present invention.

Referring to FIG. 1, there is shown a typical fuel dispensing installation including an above-ground liquid fuel storage tank 10. The fuel from storage tank 10 is delivered through gate valve 12 and into a fuel supply line or conduit 14. The fuel is then delivered to any one of a plurality of remote dispensers 16 having a nozzle 18. Each individual dispenser 16 includes a conventional suction pump (not shown) for pumping fuel through the nozzle.

Figure 2:
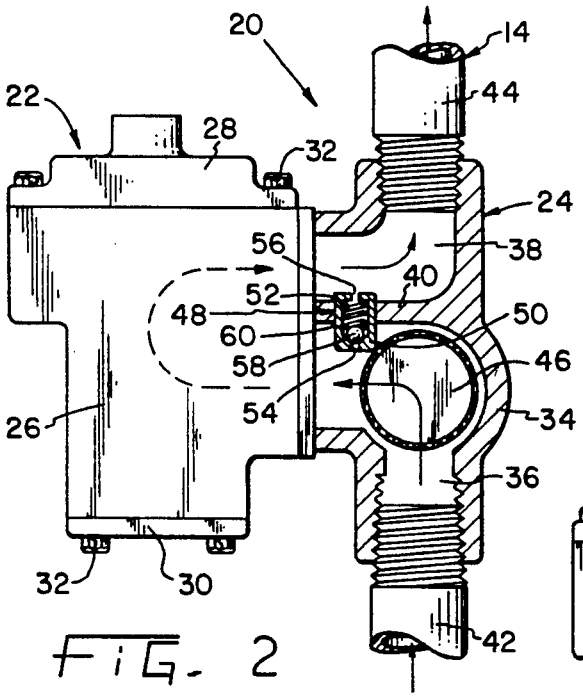
FIG. 2 is an enlarged cross-sectional view of the pressure regulator and pressure relief device of FIG. 1, particularly showing the pressure relief valve in a closed position.

As shown in FIG. 1, dispenser 16 includes a pressure regulator 20 in fluid communication with conduit 14 for controlling line pressure in the conduit. Referring to FIG. 2, pressure regulator 20 includes a valve housing segment 22 and a conduit housing segment 24 in fluid communication with valve segment 22. Segments 22 and 24 are connected together by bolts (not shown). Valve segment 22 includes a body portion 26, in which a regulator valve (not shown) is operably disposed. Body portion 26 is sealed by axially opposed cover portions 28 and 30, which are each secured to body portion 26 by bolts 32. Conduit segment 24 includes a body portion 34, an inlet passage 36, an outlet passage 38, and a barrier portion 40 disposed between passages 36 and 38. Inlet passage 36 is threadedly connected to an upstream portion 42 of conduit 14, and outlet passage 38 is threadedly connected to downstream portion 44 of conduit 14.

As shown in FIG. 2, the path of liquid fuel flow is indicated by the arrows. Upon actuation of the suction pump, fuel is delivered through upstream portion 42 of conduit 14 and into inlet passage 36 of conduit segment, 24. The fuel is then filtered by strainer screen 46 and flows through valve portion 22 and out through outlet passage 38 and into downstream portion 44 of conduit 14 toward nozzle 18. An example of pressure regulator 20 is the Model 52 Pressure Regulator, commercially available from Tokheim Corporation in Fort Wayne, Ind.

In accordance with the present invention, a pressure relief device 48 is installed in barrier 40 and includes a generally cylindrical body 50 having an axially extending passage 52 therethrough. Passage 52 includes inlet 54 and outlet 56. A valve assembly comprising a ball 58 and a spring 60 is operatively disposed within passage 52 such that spring 60 biases ball 58 adjacent inlet 54 as is shown in FIG. 2 to seal inlet 54 inlet passage 36. Although a ball and spring valve is shown, other types of valves may be used to accomplish pressure release, such as a poppet-type valve.

Figure 3:
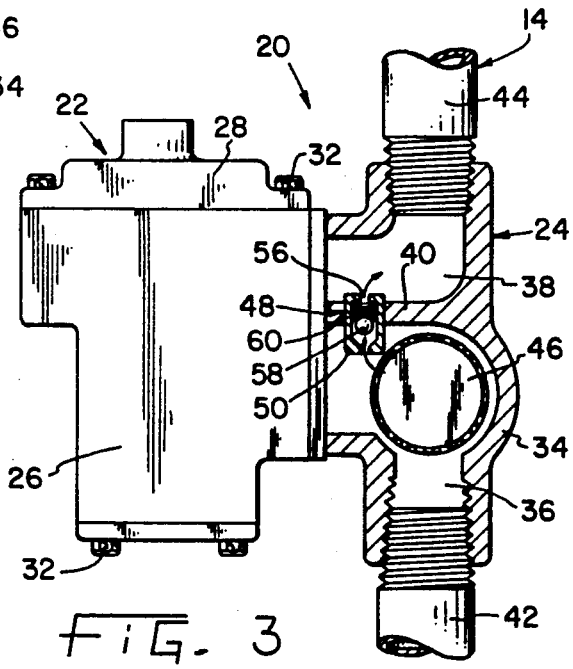
FIG. 3 is a view similar to FIG. 2, but particularly showing the valve in its fully opened position.

When an operator wishes to dispense fuel from nozzle 18, the suction pump is actuated so that fuel flows through regulator 20 as described heretofore. When the operator is finished dispensing fuel, the suction pump is turned off thereby closing the regulator valve and preventing fuel from flowing from upstream portion 42 to downstream portion 44 of conduit 14. If the suction pump is off for an extended period of time, atmospheric and other outside conditions may cause the vapor pressure of the fuel to significantly increase. If the vapor pressure of the fuel in storage tank 10 and upstream conduit portion 42 increases to a predetermined amount, the vapor pressure will overcome the force of spring 60 to lift ball 58 thereby opening inlet 54 to allow fluid communication between passage 52 and inlet passage 36, as shown in FIG. 3. As the small amount of fuel is allowed to flow through passage 52 from upstream portion 42 to downstream portion 44, the vapor pressure of the fuel in upstream portion 42 will decrease until ball 58 returns to its original position of sealingly engaging inlet 50. The fuel flowing through passage 52 is generally a very small amount and will pass into the air eliminator chamber (not shown) of the suction pump and thus be contained therein so that no fuel product is spilled on the ground.

It will be appreciated that the foregoing is presented by way of illustration only, and not by way of any limitation, and that various alternatives and modifications may be made to the illustrated embodiment without departing from the spirit and scope of the invention.

What is claimed is:

1. A liquid fuel dispensing system comprising:

a reservoir of liquid fuel, said liquid fuel having a vapor pressure;

a valved nozzle;

a fuel conduit providing the flow of fuel from the reservoir to the nozzle;

actuable pump means for pumping fuel through the conduit;

regulator valve means in said conduit for permitting the passage of fuel through said conduit upon actuation of said pump means, said regulator valve means having an inlet and an outlet, said conduit having an upstream portion positioned between the reservoir and said inlet and a downstream portion positioned between said outlet and said nozzle;.

passage means arranged in parallel with said regulator valve means for permitting fuel to flow directly from said upstream portion to said downstream portion and to bypass said regulator valve means; and pressure relief valve means associated with said passage means for intermittently enabling the flow of fuel from said upstream portion to said downstream portion, said pressure relief valve means enabling fuel flow when the vapor pressure of fuel in said upstream portion exceeds a predetermined value.

2. The system according to claim 1, wherein said pressure relief valve means is a spring-loaded poppet valve.

3. The system according to claim 1, wherein said pressure relief valve means is a ball and spring valve.

4. The system according to claim 1, wherein said reservoir is above ground.

* * * * *